US012550987B2

(12) United States Patent
Che

(10) Patent No.: US 12,550,987 B2
(45) Date of Patent: Feb. 17, 2026

(54) WIRELESS EARPHONE CASE

(71) Applicant: Jiangxi Luxshare Intelligent Manufacture Co., Ltd., Ji'an (CN)

(72) Inventor: Kai Che, Ji'an (CN)

(73) Assignee: JIANGXI LUXSHARE INTELLIGENT MANUFACTURE CO., LTD., Ji'an (CN)

( * ) Notice: Subject to any disclaimer, the term of this patent is extended or adjusted under 35 U.S.C. 154(b) by 0 days.

(21) Appl. No.: 18/677,271

(22) Filed: May 29, 2024

(65) Prior Publication Data

US 2025/0295208 A1 Sep. 25, 2025

(30) Foreign Application Priority Data

Mar. 21, 2024 (CN) ..... 202410330085.3

(51) Int. Cl.
*A45C 11/00* (2006.01)
*A45C 13/12* (2006.01)

(52) U.S. Cl.
CPC ..... *A45C 11/00* (2013.01); *A45C 13/12* (2013.01); *A45C 11/001* (2025.01)

(58) Field of Classification Search
CPC ..... A45C 11/00; A45C 13/12; A45C 11/001; A45C 13/123; G06F 1/1629; H04M 1/0203; E05B 73/0023
USPC ..... 206/701, 1.5, 320
See application file for complete search history.

(56) References Cited

FOREIGN PATENT DOCUMENTS

| | | | |
|---|---|---|---|
| CN | 210018171 U | | 2/2020 |
| CN | 111556392 | * | 8/2020 |
| CN | 111556392 A | | 8/2020 |
| CN | 113365184 | * | 9/2021 |
| CN | 113490095 | * | 10/2021 |
| CN | 114598956 | * | 6/2022 |
| CN | 114598958 | * | 6/2022 |

* cited by examiner

*Primary Examiner* — Rafael A Ortiz
(74) *Attorney, Agent, or Firm* — Birch, Stewart, Kolasch & Birch, LLP

(57) ABSTRACT

Provided is a wireless earphone case. The wireless earphone case includes a casing, a top cover, and a lock mechanism. An earphone slot is disposed in the casing. The top cover is slidably mounted on the opening end of the casing. The top cover has a closed position and an open position. The wireless earphone case is in the open state when the top cover is in the open position and in the closed state when the top cover is in the closed position. The lock mechanism includes a lock assembly disposed in the casing and a flick block movably disposed on the top cover. The lock assembly is configured to lock the top cover in the closed position. The flick block is configured to move the lock assembly relative to the casing to make the lock assembly release lock of the top cover.

18 Claims, 9 Drawing Sheets

WIRELESS EARPHONE CASE

CROSS-REFERENCE TO RELATED APPLICATION(S)

This application claims priority to Chinese Patent Application No. 202410330085.3 filed with the China National Intellectual Property Administration (CNIPA) on Mar. 21, 2024, the disclosure of which is incorporated herein by reference in its entirety.

TECHNICAL FIELD

The present disclosure relates to the field of wireless earphone technologies, particularly a wireless earphone case.

BACKGROUND

A wireless Bluetooth earphone can be connected to an electronic device by using Bluetooth communication technology. Wireless Bluetooth earphones are favored by a large number of users because of the features including user-friendliness and good sound effect. A wireless Bluetooth earphone is usually equipped with a charging case and can be stored in the charging case when not in use. The charging case can charge the wireless Bluetooth earphone while storing the wireless Bluetooth earphone.

In the related art, the charging case generally includes a casing and a cover. A charging cradle is disposed in the casing to receive the wireless Bluetooth earphone. The cover is rotatably connected to the casing and can cover the charging cradle to prevent impurities such as dust from entering the charging cradle. To ensure the reliability of the connection between the casing and the cover, the casing and the cover are usually magnetically fastened to each other. When the wireless Bluetooth earphone requires to be taken out, the casing and the cover are manually separated from each other. After the earphone is taken out, the cover and the casing are fastened to each other.

However, when the charging case is placed next to another electronic device, the magnetism of the charging case interferes with signals of the other electronic device. In addition, when interfered by the external magnetic field, the charging case runs the risk of losing magnetism, causing the casing to fail to effectively receive the wireless Bluetooth earphone, causing a risk of losing the wireless Bluetooth earphone, and causing the casing and the charging case to have a short service life.

SUMMARY

The present disclosure provides a wireless earphone case. The wireless earphone case has no risk of losing magnetism so that the wireless earphone case can store a wireless earphone more reliably, the wireless earphone is less prone to loss, and the wireless earphone case also has a longer service life.

According to this conception, the following describes solutions of the present disclosure:

A wireless earphone case has a closed state and an open state. The wireless earphone case includes a casing, a top cover, and a lock mechanism.

One end of the casing has an opening. An earphone slot is disposed in the casing.

The top cover is slidably mounted on the opening end of the casing. The top cover has a closed position and an open position. The wireless earphone case is in the open state when the top cover is in the open position and in the closed state when the top cover is in the closed position.

The lock mechanism includes a lock assembly disposed in the casing and a flick block movably disposed on the top cover. The lock assembly is configured to lock the top cover in the closed position. The flick block is configured to move the lock assembly relative to the casing to make the lock assembly release lock of the top cover.

In some embodiments, the lock assembly includes two lock groups and a drive rod connected between the two lock groups. The two lock groups are disposed on two opposite first-side inner walls of the casing. The two lock groups are configured to lock the top cover in the closed position. The flick block is configured to move the drive rod relative to the casing.

In some embodiments, the lock group includes a stop block and an elastic member. The drive rod is connected to the stop block. The stop block is slidably disposed on a first-side inner wall of the casing in a first direction and configured to lock the top cover in the closed position. The elastic member extends in the first direction. Two ends of the elastic member are connected to the stop block and a second side inner wall of the casing in the first direction respectively. The flick block is configured to move the drive rod in the direction the elastic member can be pressed.

In some embodiments, the stop block has a stop protrusion on the surface of the stop block facing away from the elastic member. The stop protrusion is configured to abut against the top cover to lock the top cover.

In some embodiments, two guide blocks are disposed on the bottom surface of the top cover. The two guide blocks are in one-to-one correspondence with the two lock groups. The guide block is configured to, when the lock group locks the top cover, abut against a respective guide block to prevent the guide block and the top cover from moving in a second direction. The second direction is perpendicular to the first direction.

In some embodiments, two guide blocks are disposed on the bottom surface of the top cover, two opposite first-side inner walls are provided, each first-side inner wall is provided with a first slideway, two first slideways are in one-to-one correspondence with the two guide blocks, and each guide block is slidably disposed in a respective first slideway.

In some embodiments, the first slideway includes a narrow slideway segment and a wide slideway segment. The width of the wide slideway segment in the second direction is greater than the width of the narrow slideway segment in the second direction. The guide block is located in a respective wide slideway segment when the top cover is in the closed position. The narrow slideway segment extends in the first direction. The guide block is slidable in a respective narrow slideway segment.

In some embodiments, a connection between the wide slideway segment and the narrow slideway segment is a tapered structure.

In some embodiments, a mounting slot is disposed on the top surface of the top cover. A through hole is formed on the slot bottom of the mounting slot. The flick block is rotatably disposed in the mounting slot. The flick block has a flick end. The flick end extends through the through hole. The flick end is configured to move the lock assembly relative to the casing.

In some embodiments, the flick block has a first circular arc surface, the top cover has a second circular arc surface, and the flick block has an initial state and a flicked state.

When the flick block is in the initial state, the top surface of the flick block is coplanar with the top surface of the top cover, and the first circular arc surface and the second circular arc surface form a grip slot. When the flick block is in the flicked state, the flick end abuts against the lock assembly.

The wireless earphone case of the present disclosure has at least the following beneficial effects:

The top cover is slidably mounted on the opening end of the casing. The top cover has a closed position and an open position. The lock mechanism includes a lock assembly disposed in the casing and a flick block movably disposed on the top cover. The lock assembly is configured to lock the top cover in the closed position. The flick block is configured to move the lock assembly relative to the casing to make the lock assembly release the lock of the top cover. In this manner, the top cover can be locked to the casing by the lock assembly and can be unlocked by the flick block so that the wireless earphone case can switch between different states mechanically and thus does not require magnetic members. Thus, the wireless earphone case does not interfere with signals of another electronic device and does not run the risk of losing magnetism, thereby making the received wireless Bluetooth earphone less prone to loss and prolonging the service life of the wireless earphone case. The method for using the wireless earphone case can be easily performed.

REFERENCE LIST

Figure 1:
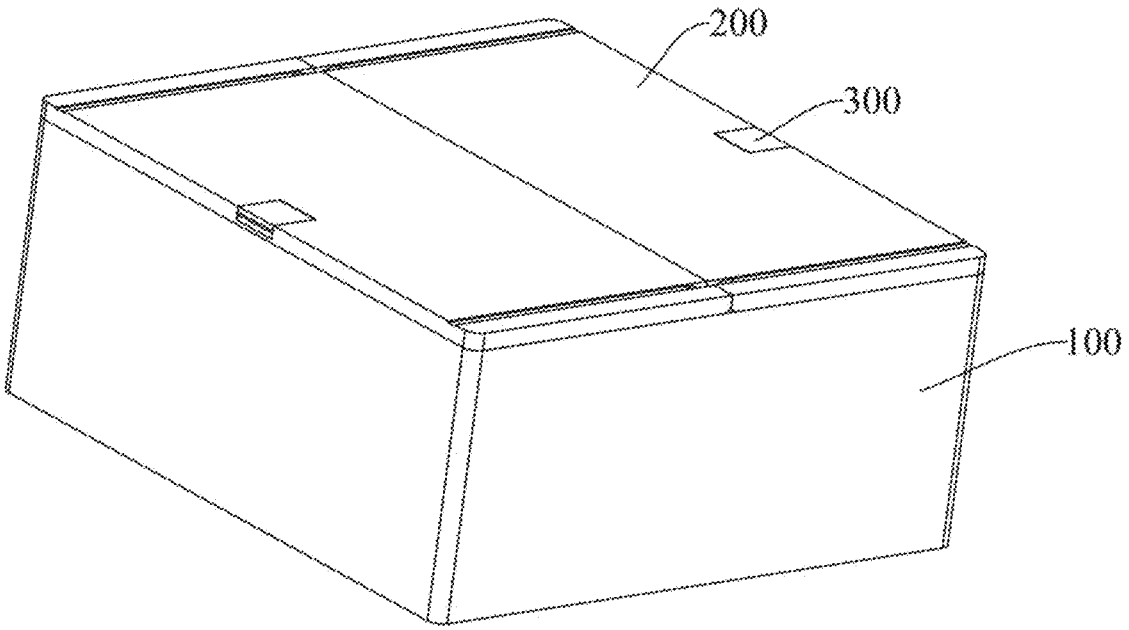
FIG. 1 is view one illustrating the structure of a wireless earphone case according to embodiments of the present disclosure.

100 casing
110 opening end
120 earphone slot
130 chute
140 first slideway
141 narrow slideway segment
142 wide slideway segment
150 stop structure
200 top cover
210 guide block
220 mounting slot
230 through hole
240 second circular arc surface
250 grip slot
260 second slideway
261 guide arc surface
270 roller
280 third circular arc surface
300 lock mechanism
310 lock assembly
311 drive rod
312 stop block
3121 stop protrusion
313 elastic member
320 flick block
321 flick end
3211 flick slot
322 first circular arc surface
X first direction
Y second direction
Z third direction

DETAILED DESCRIPTION

To make solved problems, adopted technical solutions and achieved effects of the present disclosure more apparent, the technical solutions of the present disclosure are described hereinafter in conjunction with drawings and embodiments. It is to be understood that the specific embodiments set forth below are intended to illustrate and not to limit the present disclosure. In addition, it is to be noted that for ease of description, only part, instead of all, related to the present disclosure is illustrated in the drawings.

It is to be noted that similar reference numerals and letters represent similar items in the drawings. Therefore, once an item is defined in one drawing, the item no longer needs to be defined and interpreted in the subsequent drawings.

In the description of the present disclosure, unless otherwise expressly specified and limited, the term "connected to each other", "connected", or "fixed" is to be construed in a broad sense, for example, as permanently connected, detachably connected, or integrated; mechanically connected or electrically connected; directly connected to each other or indirectly connected to each other via an intermediary; or internally connected or interactional between two components. For those of ordinary skill in the art, specific meanings of the preceding terms in the present disclosure may be construed based on specific situations.

In the present disclosure, unless otherwise expressly specified and limited, when a first feature is described as "above" or "below" a second feature, the first feature and the second feature may be in direct contact or be in contact via another feature between the two features. Moreover, when the first feature is described as "on", "above", or "over" the second feature, the first feature is right on, above, or over the second feature, the first feature is obliquely on, above, or over the second feature, or the first feature is simply at a higher level than the second feature. When the first feature is described as "under", "below", or "underneath" the second feature, the first feature is right under, below, or underneath the second feature, the first feature is obliquely under, below, or underneath the second feature, or the first feature is simply at a lower level than the second feature. In the description of the embodiments herein, "multiple" means two or more unless otherwise specified.

In the description of the embodiments herein, orientation or position relationships such as "above", "below", and "right" are based on the orientation or position relationships shown in the drawings. These orientation or position relationships are intended for ease of description and operation, not to indicate or imply that the mentioned device or element has a particular orientation and is constructed and operated in a particular orientation, and thus are not to be construed as limiting the present disclosure. In addition, the terms "first" and "second" are used only to distinguish between descriptions and have no special meaning.

Embodiment One

This embodiment provides a wireless earphone case. The wireless earphone case has no risk of losing magnetism so that the wireless earphone case can store a wireless earphone more reliably, the wireless earphone is less prone to loss, and the wireless earphone case also has a longer service life.

As shown in FIG. 1 to FIG. 11, the wireless earphone case has a closed state and an open state, and the wireless earphone case includes a casing 100, a top cover 200, and a lock mechanism 300.

One end of the casing 100 has an opening. That is, the casing 100 has an opening end 110. An earphone slot 120 is disposed in the casing 100 and configured to receive a wireless Bluetooth earphone. The top cover 200 is slidably mounted at the opening end 110 of the casing 100. The top cover 200 is slidable relative to the casing 100 to have a closed position and an open position. When the top cover 200 is in the open position, the wireless earphone case is in the open state, and a user may take out the wireless Bluetooth earphone from the earphone slot 120 or put the wireless Bluetooth earphone into the earphone slot 120 through the opening end 110. When the top cover 200 is in the closed position, the wireless earphone case is in the closed state, and the top cover 200 and the casing 100 form a receiving cavity for receiving the wireless Bluetooth earphone to prevent the wireless Bluetooth earphone from falling out of the wireless earphone case.

Figure 2:
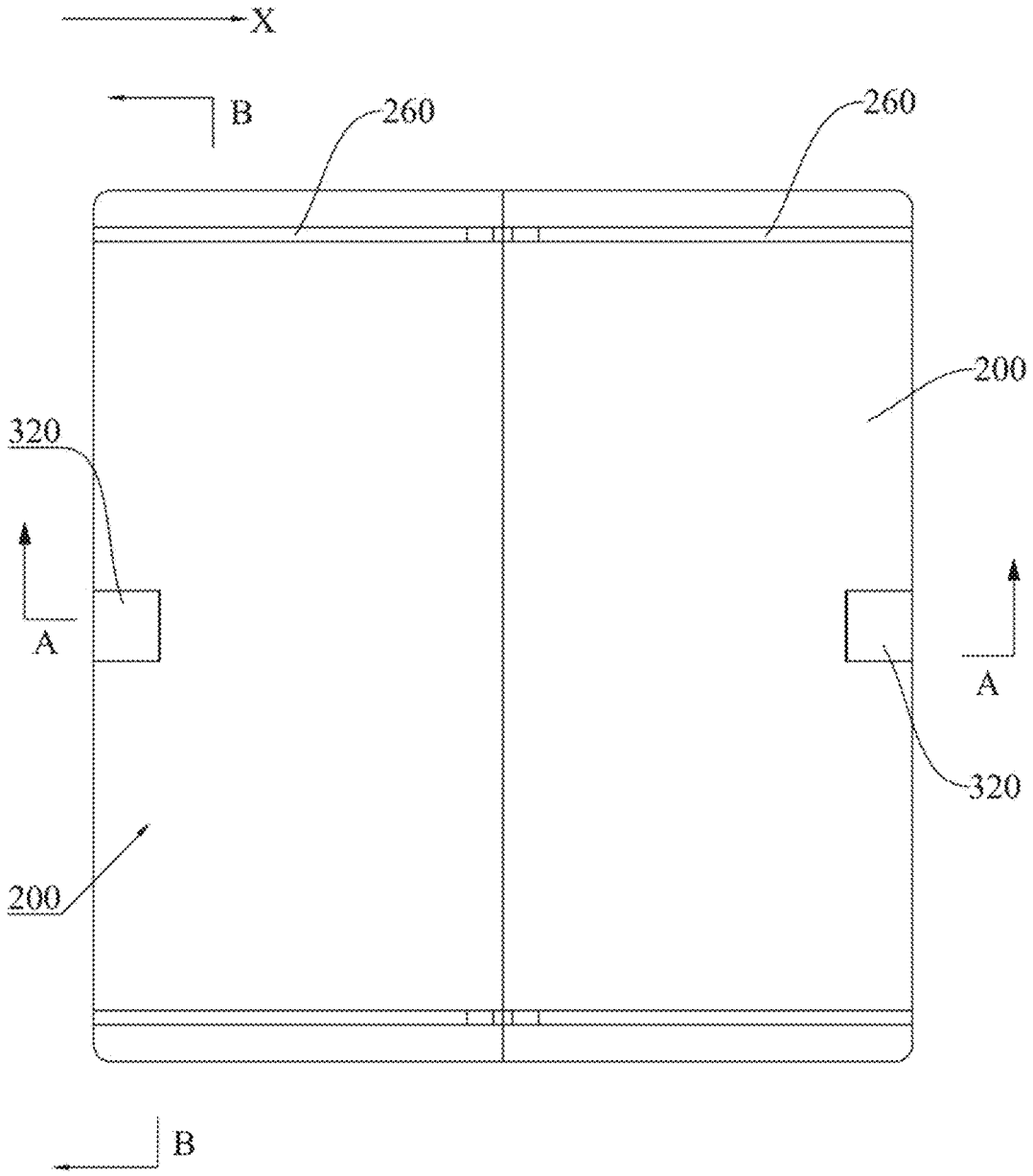
FIG. 2 is view two illustrating the structure of the wireless earphone case according to embodiments of the present disclosure.
Figure 3:
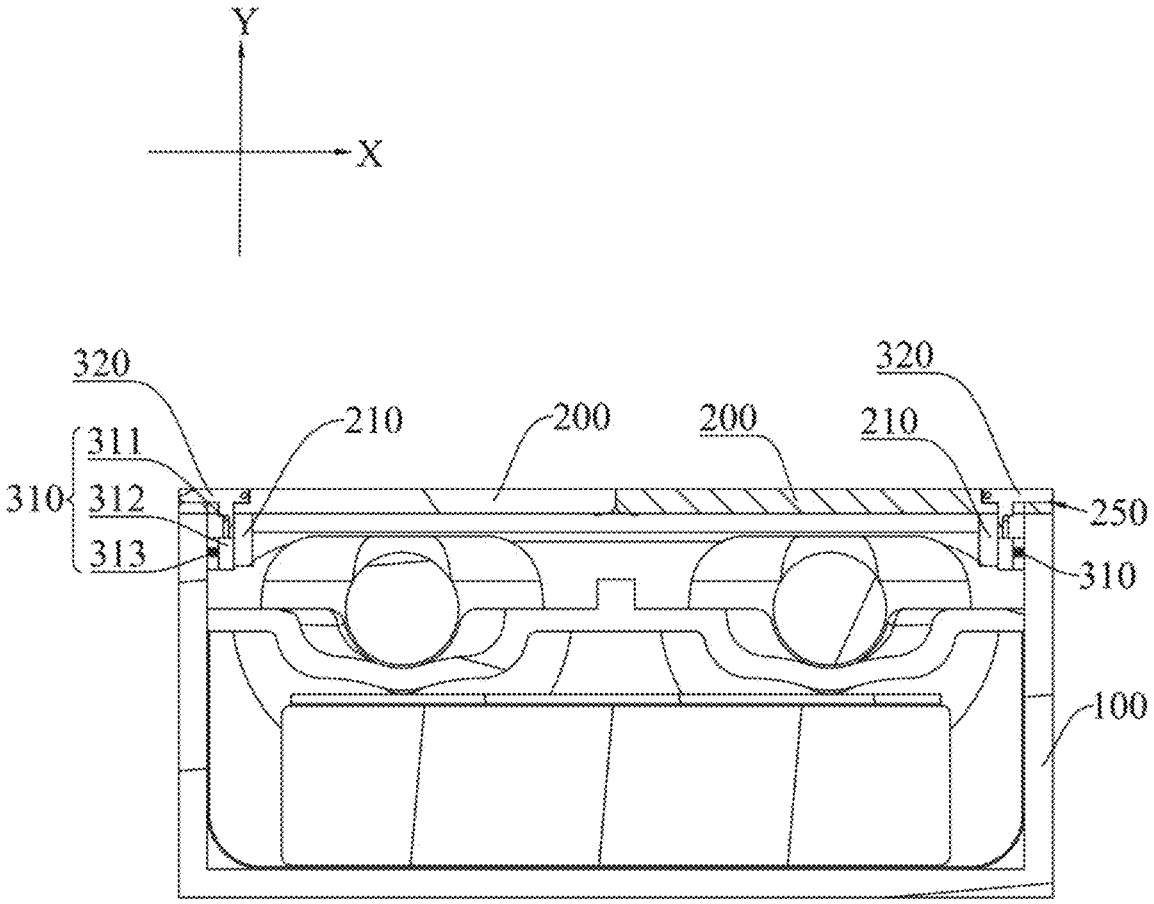
FIG. 3 is a section view taken along A-A of FIG. 2.

As shown in FIG. 2 and FIG. 3, the lock mechanism 300 includes a lock assembly 310 disposed in the casing 100 and a flick block 320 movably disposed on the top cover 200. The lock assembly 310 is configured to lock the top cover 200 in the closed position to prevent the top cover 200 from sliding relative to the casing 100 under the action of an inertia force. The flick block 320 is configured to move the lock assembly 310 relative to the casing 100 to make the lock assembly 310 release lock of the top cover 200 so that the top cover can be opened.

When using the wireless earphone case of this embodiment, the user manually drives the flick block 320 to move relative to the top cover 200 so that the lock assembly 310 moves relative to the casing 100 until the lock assembly 310 no longer locks the top cover 200. Then, the user manually pushes the top cover 200 in the cover opening direction. When the user manually pushes the top cover 200 in the cover opening direction, the top cover 200 slides relative to the casing 100 so that the earphone slot 120 is exposed gradually. The user stops pushing the top cover 200 when the top cover 200 is in the open position, and at this time, the wireless earphone case is opened, that is, in the open state. When the top cover requires to be closed, the user manually pushes the top cover 200 in the direction opposite to the cover opening direction. During this process, the top cover 200 slides relative to the casing 100 and gradually covers the opening end 110. When the top cover 200 is in the closed position, the lock assembly 310 can lock the top cover 200.

In the wireless earphone case of this embodiment, the top cover 200 is slidably mounted on the opening end 110 of the casing 100. The top cover 200 has a closed position and an open position. The lock mechanism 300 includes a lock assembly 310 disposed in the casing 100 and a flick block 320 movably disposed on the top cover 200. The lock assembly 310 is configured to lock the top cover 200 in the closed position. The flick block 320 is configured to move the lock assembly 310 relative to the casing 100 to make the lock assembly 310 release the lock of the top cover 200. In this manner, the top cover 200 can be locked to the casing 100 by the lock assembly 310 and can be unlocked by the flick block 320 so that the wireless earphone case can switch between different states mechanically and thus does not require magnetic members. Thus, the wireless earphone case does not interfere with signals of another electronic device and does not run the risk of losing magnetism, thereby making the received wireless Bluetooth earphone less prone to loss and prolonging the service life of the wireless earphone case.

Figure 9:
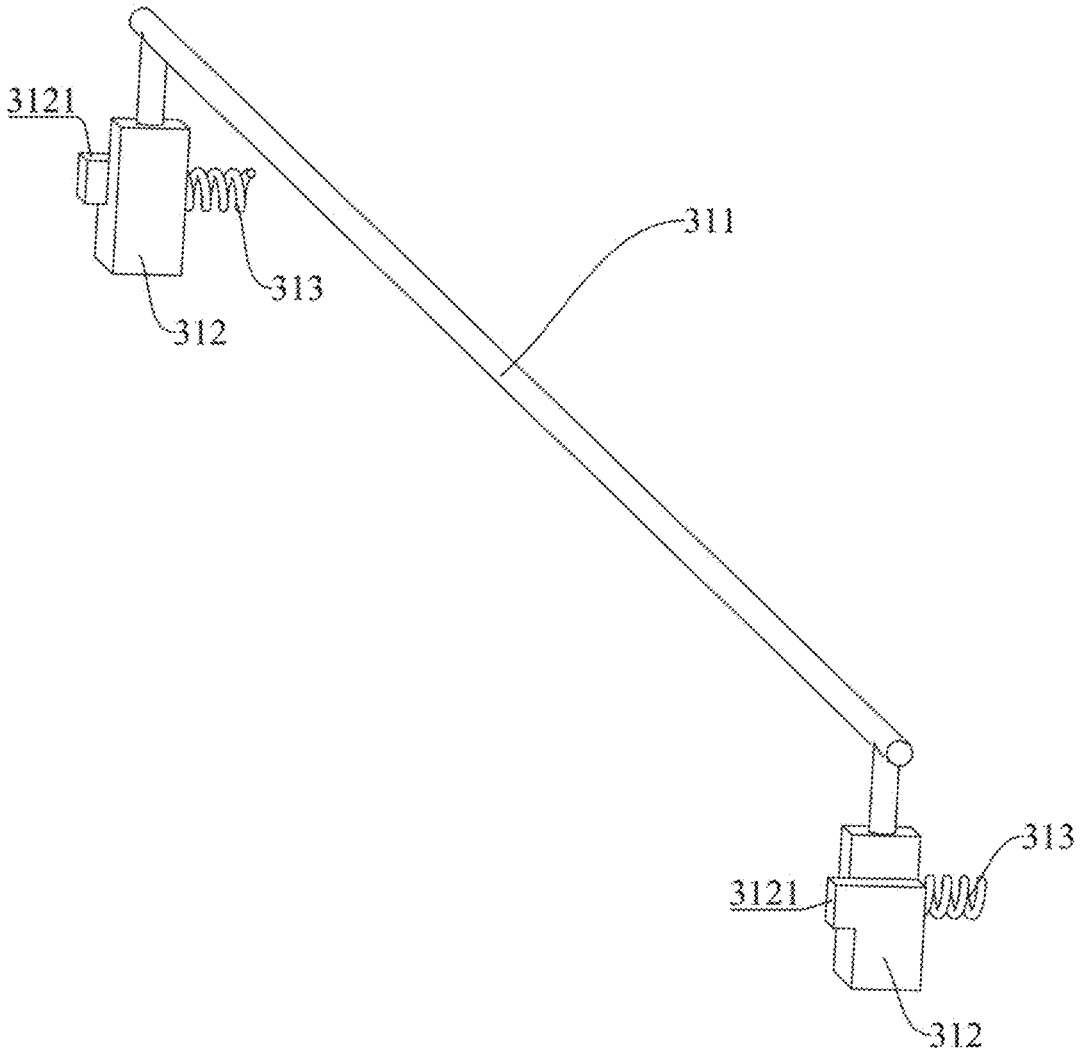
FIG. 9 is a view illustrating the structure of a lock assembly according to embodiments of the present disclosure.

In some embodiments, as shown in FIG. 3 and FIG. 9, the lock assembly 310 includes two lock groups (not shown) and a drive rod 311 connected between the two lock groups. The two lock groups are disposed on two opposite first-side inner walls 111 of the casing 100. The two lock groups are configured to lock the top cover 200 in the closed position. The two lock groups can lock the top cover 200 effectively and reliably to prevent a too large gap between the top cover 200 and the casing 100. The flick block 320 can move the drive rod 311 relative to the casing 100 so that the drive rod 311 can drive the lock groups relative to the casing 100 to release the lock of the top cover 200. The drive rod 311 enables one flick block 320 to move two lock groups simultaneously so that the lock assembly 310 can have a relatively small number of components. Illustratively, as shown in FIG. 9, the drive rod 311 is U-shaped to facilitate arrangement of the flick block 320 and the two lock groups.

Referring to FIG. 3 and FIG. 9, each lock group includes a stop block 312 and an elastic member 313. The drive rod 311 is connected to the stop block 312. The stop block 312 is slidably disposed on a first-side inner wall 111 of the casing 100 in a first direction X. The stop block 312 is configured to lock the top cover 200 in the closed position. The elastic member 313 extends in the first direction X and is connected to the stop block 312 and a second side inner wall 112 of the casing 100 in the first direction X. The flick block 320 is configured to move the drive rod 311 in the direction the elastic member 313 can be pressed to make the stop block 312 no longer stop the top cover 200. The elastic member 313 is configured to, when the top cover 200 is in the closed position, push the stop block 312 to move relative to the casing 100 to make the stop block 312 stop the top cover 200 again.

In some embodiments, a chute 130 is disposed on the first-side inner wall 111 of the casing 100. The stop block 312 is slidable in the chute 130. The chute 130 can stop the stop block 312 in the second direction Y so that the stop block 312 can slide only in the first direction X. It is to be noted that two stop blocks 312 have a limit in a third direction Z through the drive rod 311. In this embodiment, the first direction X, the second direction Y, and the third direction Z are perpendicular to each other.

Figure 11:
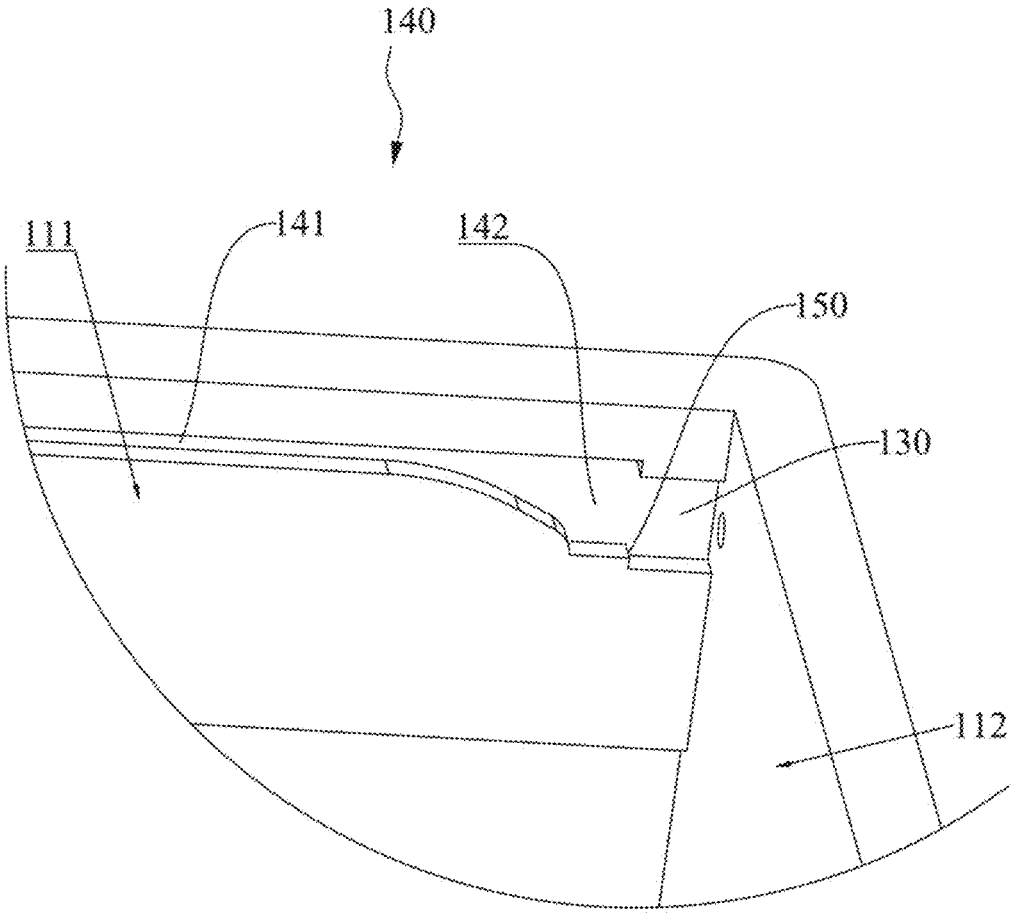
FIG. 11 is a partial enlarged view of a casing according to embodiments of the present disclosure.

Illustratively, as shown in FIG. 11, a stop structure 150 is disposed on the first-side inner wall 111 of the casing 100. The stop structure 150 is disposed at one end of the chute 130 and is configured to limit the movement extreme of the stop block 312 in the first direction X to prevent excessive movement of the stop block 312. That is, when the stop block 312 is stopped by the stop structure 150, the stop block 312 can lock the top cover 200. In this embodiment, one end of the chute 130 extends to the stop structure 150, and the other end of the chute 130 extends to a sidewall of the casing 100 connected to the elastic member 313.

In some embodiments, as shown in FIG. 9, the stop block 312 has a stop protrusion 3121 on a surface of the stop block 312 facing away from the elastic member 313. That is, two surfaces of the stop block 312 in the first direction X are connected to the stop protrusion 3121 and the elastic member 313 respectively. The stop protrusion 3121 is configured to abut against the top cover 200 to lock the top cover 200. The stop protrusion 3121 can stop and lock the top cover 200 without affecting the stop block 312 sliding in the chute 130.

Figure 4:
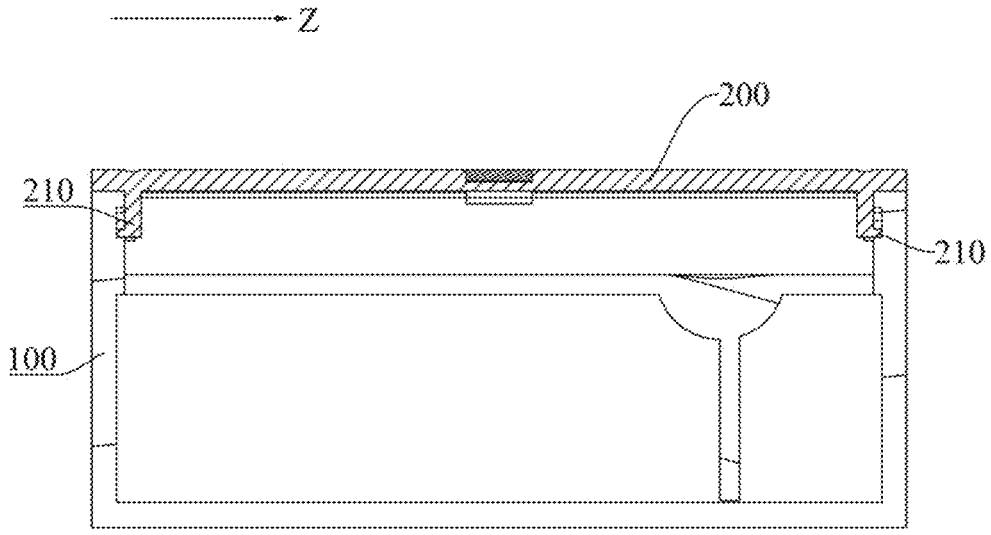
FIG. 4 is a section view taken along B-B of FIG. 2.
Figure 5:
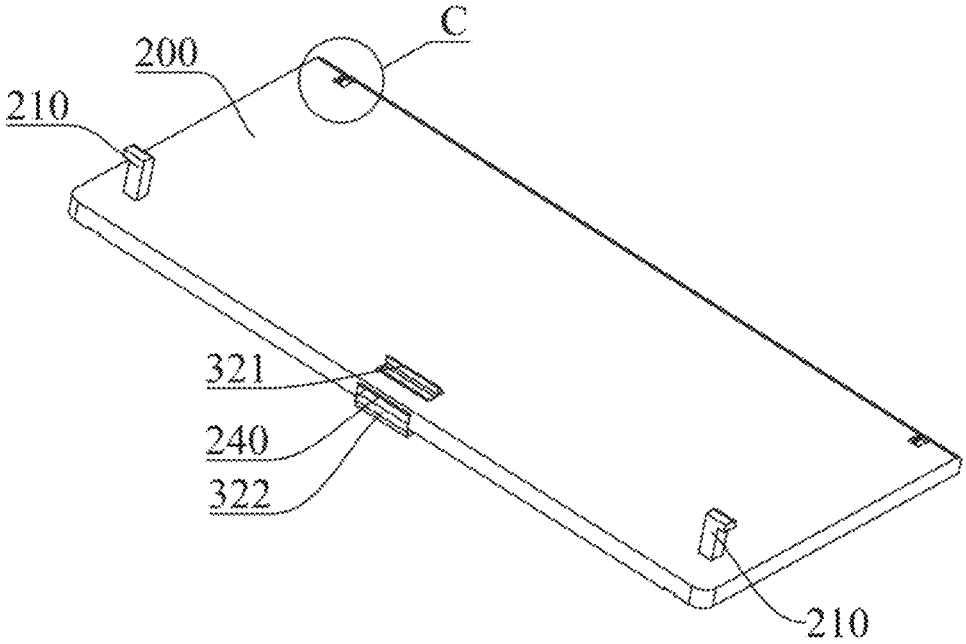
FIG. 5 is view one illustrating the structure of a top cover according to embodiments of the present disclosure.
Figure 6:
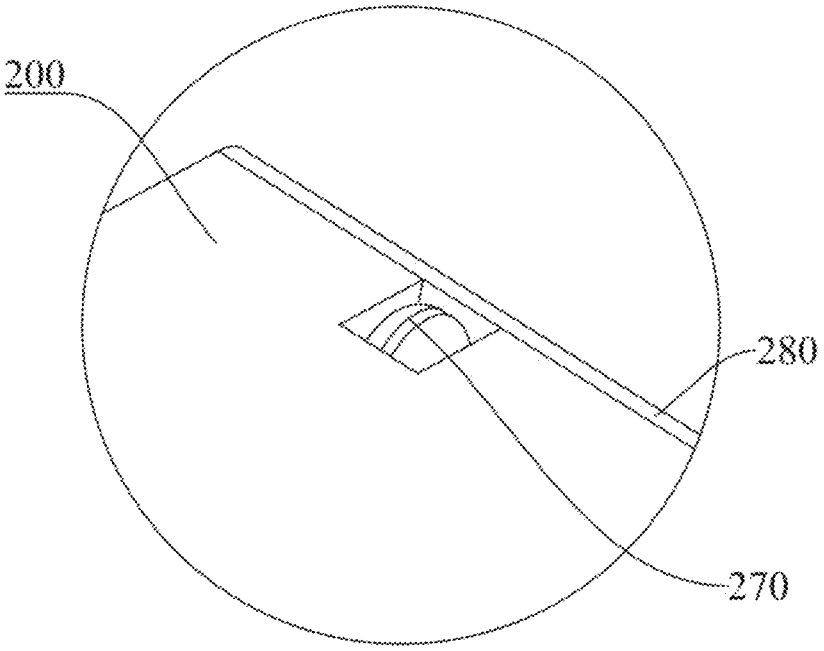
FIG. 6 is an enlarged view of C of FIG. 5.

In some embodiments, as shown in FIG. 4 and FIG. 5, two guide blocks 210 are disposed on the bottom surface of the top cover 200. The two guide blocks 210 are in one-to-one correspondence with the two lock groups. The guide block 210 is configured to, when the lock groups lock the top cover 200, abut against a corresponding lock group 210 to prevent the guide block 210 and the top cover 200 from moving in the second direction Y. As shown in FIG. 3, when the lock group locks the top cover 200, the guide block 210 abuts against the stop protrusion 3121 of the corresponding lock group. The guide block 210 includes a vertical segment and a horizontal segment that are connected to each other and perpendicular to each other. The vertical segment is connected to the top cover 200. When the lock group locks the top cover 200, the horizontal segment abuts against the stop protrusion 3121 of the corresponding lock group. For example, the horizontal segment is located under the stop protrusion 3121 so that the stop protrusion 3121 can prevent the guide block 210 and the top cover 200 from moving away from the bottom wall of the casing 100 (that is, moving in the second direction Y).

Figure 7:
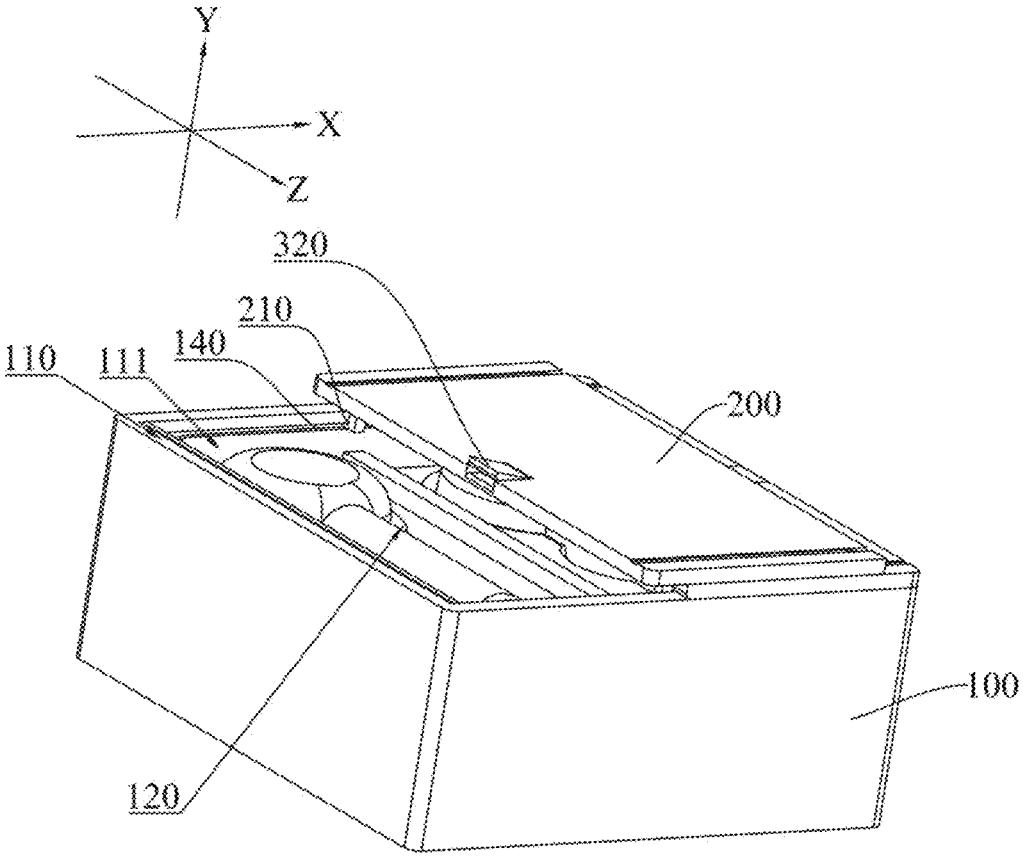
FIG. 7 illustrates the wireless earphone case in an open state according to embodiments of the present disclosure.
Figure 8:
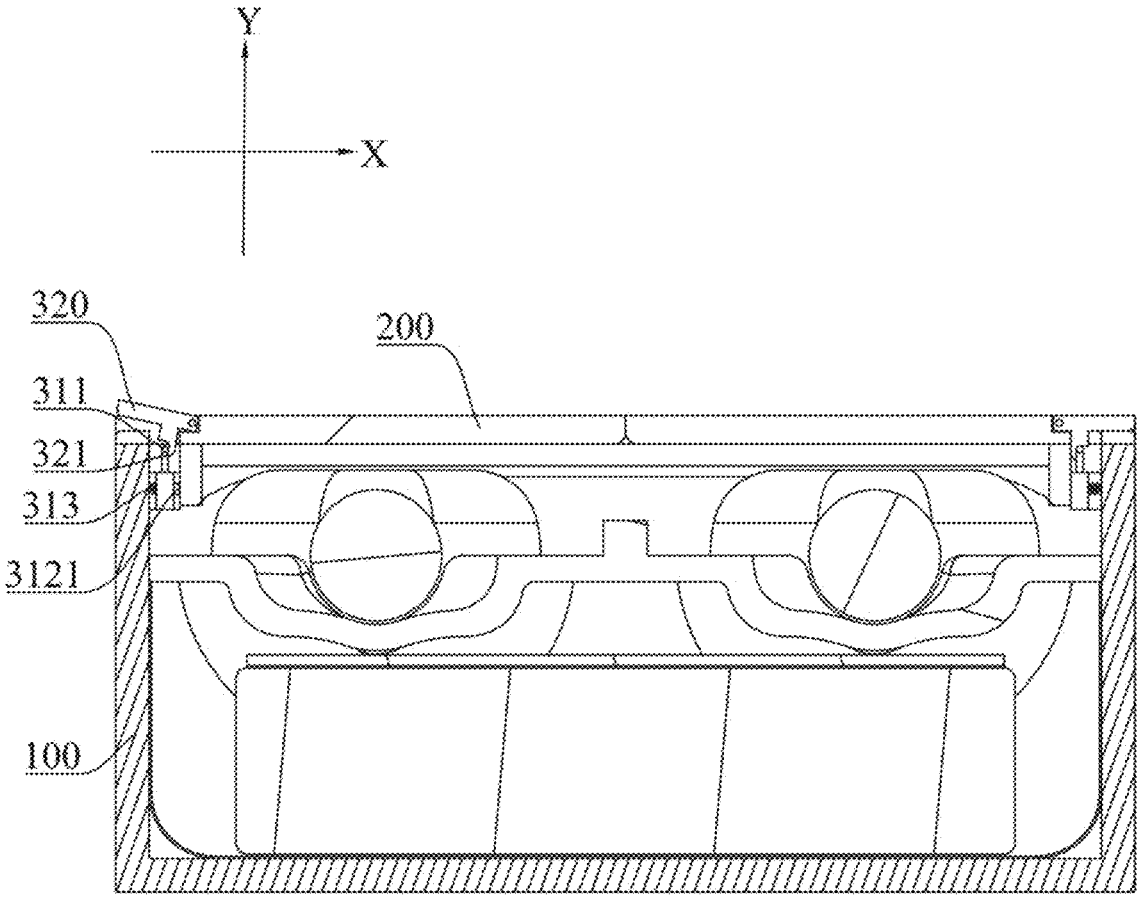
FIG. 8 is a section view of the wireless earphone case according to embodiments of the present disclosure.

In some embodiments, referring to FIG. 7 and FIG. 11, the casing 100 has two first-side inner walls 111. Each first-side inner wall 111 is provided with one first slideway 140. Each first slideway 140 extends in the first direction X. Illustratively, two first-side inner walls 111 face each other in the third direction Z. The two first slideways 140 are in one-to-one correspondence with the two guide blocks 210. Each guide block 210 is slidably disposed in a respective first slideway 140 so that the first slideway 140 can guide the guide block 210 and the top cover 200 to slide in the direction X. In this manner, the reliability and stability of the slide of the top cover 200 can be improved. It is to be noted that when the guide block 210 slides in the first slideway 140, the top cover 200 is in the open position or the closed position. It is also to be noted that when the lock groups do not lock the top cover 200, the horizontal segment of the guide block 210 can slide in the first slideway 140.

Figure 10:
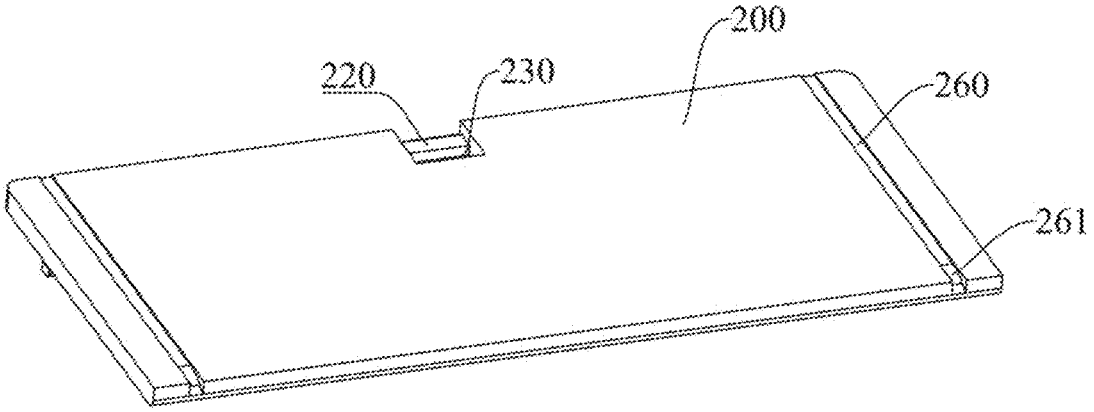
FIG. 10 is view two illustrating the structure of the top cover according to embodiments of the present disclosure.

In some embodiments, as shown in FIG. 10, a mounting slot 220 is disposed on the top surface of the top cover 200. A through hole 230 is formed on the slot bottom of the mounting slot 220. The through hole 230 extends to the bottom surface of the top cover 200. In this embodiment, the top surface of the top cover 200 is an exposed surface, and the bottom surface of the top cover 200 is a surface facing the earphone slot 120. In this embodiment, to make it easier to drive the flick block 320, the mounting slot 220 extends to the edge of the top cover 200 in the first direction X.

The flick block 320 is rotatably disposed in the mounting slot 220. In some embodiments, the flick block 320 is rotatably mounted in the mounting slot 220 by using a rotary shaft. When the flick block 320 is manually driven, the flick block 320 rotates around the rotary shaft. The flick block 320 has a flick end 321. The flick end 321 extends through the through hole 230. The flick end 321 is configured to move the lock assembly 310 relative to the casing 100. That is, the flick end 321 can be in contact with the drive rod 311 and can move the drive rod 311 relative to the casing 100. In some embodiments, the flick end 321 can move the drive rod 311 in the direction the elastic member 313 can be pressed.

Figure 12:
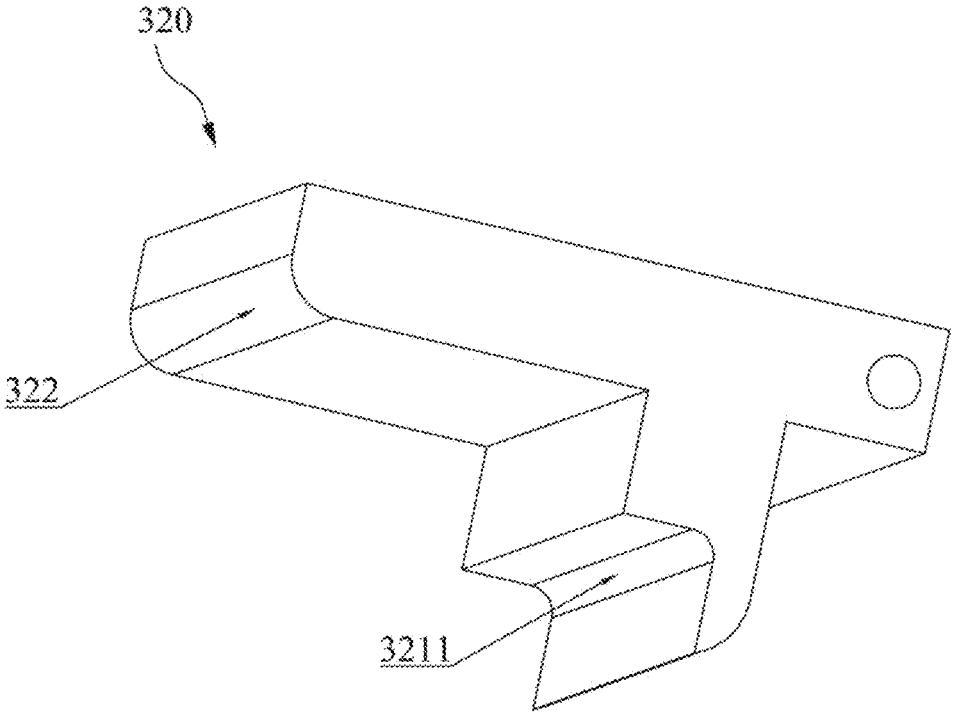
FIG. 12 is a view illustrating the structure of a flick block according to embodiments of the present disclosure.

Illustratively, the section of the flick block 320 of this embodiment is V-shaped, the rotary shaft extends through the middle of the flick block 320 so that when the user moves one end of the flick block 320, the other end of the flick block 320 can be driven to move the drive rod 311. In some embodiments, as shown in FIG. 12, the flick end 321 is provided with a flick slot 3211. The drive rod 311 is located in the flick slot 3211. When the flick block 320 rotates under an external force, the flick end 321 drives, through the slot wall of the flick slot 3211, the drive rod 311 to move. The flick slot 3211 enables the flick end 321 to drive the drive rod 311 more successfully and reliably. It is to be noted that the flick slot 3211 is L-shaped so that the drive rod 311 does not affect movement of the flick block 320 in the first direction X.

As shown in FIG. 5, the flick block 320 has a first circular arc surface 322, and the top cover 200 has a second circular arc surface 240. The flick block 320 has an initial state and a flicked state. When the flick block 320 is in the initial state, the top surface of the flick block 320 is coplanar with the top surface of the top cover 200 so that the wireless earphone case looks neat and beautiful. When the flick block 320 is in the initial state, the lock assembly 310 locks the top cover 200, and the flick end 321 is in contact with or in no contact with the drive rod 311. In addition, as shown in FIG. 3, the first circular arc surface 322 and the second circular arc surface 240 form a grip slot 250. The user can put part of fingers in the grip slot 250 so that the user can move the flick block 320 more easily. When the flick block 320 is in the flicked state, the flick end 321 abuts against the drive rod 311 of the lock assembly 310.

In some embodiments, as shown in FIG. 2, two top covers 200 are provided, and two earphone slots 120 are disposed in the casing. When the two top covers 200 are both in the closed position, the two earphone slots 120 are in one-to-one correspondence with the two top covers 200, and each top cover 200 faces a corresponding earphone slot 120 in the second direction Y. When a top cover 200 is in the open position, the earphone slot 120 corresponding to the top cover 200 is exposed by the opening end 110.

It is to be noted that guide blocks 210 on the same side of the two top covers 200 can slide in the same first slideway 140, and the first slideway 140 can be shared so that it is not required to arrange multiple first slideways 140 on one sidewall of the casing 100.

In this embodiment, when the two top covers 200 are both in the closed position, as shown in FIG. 1 or FIG. 2, the two top covers 200 can cooperate to cover the opening end 110 to close the casing 100 to form a relatively closed receiving space. When one of the two top covers 200 is in the open position, as shown in FIG. 7, the earphone slot 120 corresponding to the top cover 200 is exposed by the opening end 110, and the two top covers 200 are partially stacked so that the top space of the other top cover 200 is fully used. It is to be noted that at most one of the two top covers 200 is in the open position.

When two top covers 200 are provided, two lock mechanisms 300 are provided. The two lock mechanisms 300 are in one-to-one correspondence with the two top covers 200. Each lock mechanism 300 is configured to lock a corresponding top cover 200 in the closed position.

In some embodiments, as shown in FIG. 11, the width direction of the first slideway 140 is the second direction Y. In the first direction X, the width of each end of the first slideway 140 is larger than the width of the middle of the first slideway 140. That is, each end of the first slideway 140 is wider than the middle of the first slideway 140. The guide block 210 at the end of the first slideway 140 in the first direction X can move in the second direction Y, that is, the top cover 200 can move in the second direction Y, so that the guide block 210 can move to below the stop block 312 and then be locked by the stop block 312. In this embodiment, the top cover 200 moves in the second direction Y under an external force, for example, a press against the top cover 200 by the user.

In this embodiment, the first slideway 140 includes a narrow slideway segment 141 and a wide slideway segment 142. The width of the wide slideway segment 142 in the second direction Y is greater than the width of the narrow slideway segment 141 in the second direction Y. The guide block 210 is located in a corresponding wide slideway segment 142 when the top cover 200 is in the closed position and is located in a corresponding narrow slideway segment 141 when the top cover 200 is in the open position. The narrow slideway segment 141 extends in the first direction X. That is, the length direction of the narrow slideway segment 141 is the first direction X. The guide block 210 can slide in the narrow slideway segment 141 to move from the closed position to the open position.

In some embodiments, the connection between the wide slideway segment 142 and the narrow slideway segment 141 is a tapered structure, that is, the wide slideway segment 142 gradually transitions to the narrow slideway segment 141 so that the guide block 210 is less stuck when sliding, that is, can slide more smoothly, and thus the top cover 200 can be opened more smoothly.

In this embodiment, when two top covers 200 are provided, each first slideway 140 includes two wide slideway segments 142. The two wide slideway segments 142 are located at two ends of the narrow slideway segment 141. That is, the middle of the first slideway 140 is named the narrow slideway segment 141, and each of the two ends of the first slideway 140 is named the wide slideway segment 142. The wide slideway segment 142 is tapered towards the narrow slideway segment 141. When the top cover 200 is pushed in the first direction X, the horizontal segment of the guide block 210 slides from the wide slideway segment 142 to the narrow slideway segment 141 so that a smooth transition is achieved. In this embodiment, the position of the guide block 210 in the narrow slideway segment 141 is higher than the position of the guide block 210 in the wide slideway segment 142 so that one top cover 200 can slide to above the other top cover 200, that is, the guide block 210 guided by the wide slideway segment 142 can move a distance in the second direction Y, so that the top cover 200 on which the guide block 210 is located is no longer flush with the other top cover 200, but is higher than the other top cover 200.

In some embodiments, an end of the first slideway 140 is connected to the chute 130 so that the guide block 210 cooperates with the stop block 312.

In some embodiments, as shown in FIG. 2 and FIG. 10, a second slideway 260 is disposed on the top surface of each top cover 200; and a roller 270 is disposed on the bottom surface of each top cover 200. The second slideway 260 extends in the first direction X. The roller 270 on one top cover 200 can roll in the second slideway 260 on the other top cover 200 so that the second slideway 260 can guide the top cover 200 to slide. The first slideway 140 and the second slideway 260 can both guide the top cover 200 to slide so that the reliability and directivity of the top cover 200 can be further improved. Illustratively, the roller 270 may be a rolling wheel. The rolling wheel is rotatably disposed on the top cover 200. The part of the rolling wheel protruding from the top cover 200 is configured to slide in the second slideway 260. The roller 270 may be a rolling ball. The top cover 200 has a rolling space. The opening diameter of the rolling space is less than the diameter of the rolling ball. The part of the rolling ball exposed by the opening can roll in the second slideway 260.

In some embodiments, the roller 270 is disposed at such a position that when the top covers 200 are both in the closed state, the roller 270 is disposed at the end of one top cover 200 facing the other top cover 200 so that when the top cover 200 slides, the roller 270 can quickly enter the second slideway to guide the top cover 200 as soon as possible, enabling the top cover 200 to slide more stably.

On each top cover 200, two second slideways 260 and two rollers 270 are disposed so that each top cover 200 can slide more stably.

In some embodiments, referring to FIG. 10, a guide arc surface 261 is disposed on one end of the second slideway 260. When the two top covers 200 are both in the closed state, the guide arc surface 261 is provided on the end of the second slideway 260 located on one top cover 200 facing the other top cover 200. The guide arc surface 261 is configured to guide the roller 270 to the second slideway 260 so that the roller 270 is less stuck when sliding, that is, can slide to the second slideway more smoothly. In this embodiment, the end face of one top cover 200 facing the other top cover 200 is a third circular arc surface 280, reducing the friction between the two top covers 200.

The wireless earphone case of this embodiment uses a new dual-slideway cover opening mode. This design is unique and improves the user experience. Moreover, the wireless earphone case is a new, simple, and user-friendly structure.

Embodiment Two

This embodiment provides a method for using a wireless earphone case. The method is applied by the wireless earphone case of embodiment one. The method for using the wireless earphone case includes cover opening steps and cover closing steps.

The cover opening steps are as follows:

In S101, the flick block 320 is controlled to move relative to the top cover 200 so that the flick block 320 moves the lock assembly 310 relative to the casing 100 to make the lock assembly 310 release lock of the top cover 200.

In step S101, the flick block 320 can be manually moved.

In S102, in the cover opening direction, the top cover 200 in the closed position is pushed to slide relative to the casing 100 to the open position so that the wireless earphone case is in the open state.

In step S102, the cover opening direction is the same as the first direction X. When one top cover 200 is provided, the top cover 200 is pushed in the first direction X to slide relative to the casing 100. When two top covers 200 are provided, the top cover 200 that requires to be opened is pushed to move towards the other top cover 200 so that the top cover 200 that requires to be opened is opened. The wireless earphone case is considered to be in the open state when at least one top cover 200 is in the open state. The wireless earphone case is considered to be in the closed state when the two top covers 200 are in the closed state.

The cover closing steps are as follows:

In S201, the top cover 200 in the open position is pushed in the direction opposite to the cover opening direction so that the top cover 200 slides relative to the casing 100.

In S202, when the top cover 200 is in the closed position, the top cover 200 in the closed position is locked by the lock assembly 310.

It is to be noted that when the top cover 200 is in the closed position, the lock assembly 310 can automatically lock the top cover 200 by using a magnetic-free mechanical structure.

In the method for using the wireless earphone case according to this embodiment, the top cover 200 of the wireless earphone case is slidably mounted on the opening end 110 of the casing 100. The top cover 200 has a closed position and an open position. The lock mechanism 300 includes a lock assembly 310 disposed in the casing 100 and a flick block 320 movably disposed on the top cover 200. The lock assembly 310 is configured to lock the top cover 200 in the closed position. The flick block 320 is configured to move the lock assembly 310 relative to the casing 100 to make the lock assembly 310 release lock of the top cover 200. In this manner, the top cover 200 can be locked to the casing 100 by the lock assembly 310 and can be unlocked by the flick block 320 so that the wireless earphone case can switch between different states mechanically and thus does not require magnetic members. Thus, the wireless earphone case does not interfere with signals of another electronic device and does not run the risk of losing magnetism, thereby making the received wireless Bluetooth earphone less prone to loss and prolonging the service life of the wireless earphone case. The method for using the wireless earphone case can be easily performed.

In some embodiments, when the lock assembly 310 includes two lock groups and a drive rod 311 connected between the two lock groups, the lock group includes a stop block 312 and an elastic member 313, and the top cover 200 has a guide block 210, the method for using the wireless earphone case is as follows:

Step S101 includes controlling the flick block 320 to move relative to the top cover 200, and moving the drive rod 311 and the stop block 312 in the direction the elastic member 313 can be pressed to make the stop block 312 release lock of the top cover 200. In some embodiments, a stop protrusion 3121 on the stop block 312 no longer stops the guide block 210 in the second direction Y.

Step S202 includes the following steps:

In S2021, the surface of the stop block 312 in the first direction X abuts against the guide block 210 on the top cover 200 and presses the elastic member 313.

In step S2021, the top cover 200 is pushed by an external force such that the guide block 210 slides from a narrow slideway segment 141 to a wide slideway segment 142 and abuts against the surface of the stop protrusion 3121 in the first direction X. At this time, the stop protrusion 3121 does not stop the guide block 210. In step S2021, the flick block 320 is in contact with the drive rod 311.

In S2022, the top cover 200 is pressed such that the guide block 210 moves in the direction opposite to the second direction Y, and the guide block 210 and the stop block 312 are staggered.

The top cover 200 is pressed by an external force such that the guide block 210 moves relative to the stop protrusion 3121 so that the guide block 210 and the stop block 312 are staggered in the second direction Y, and thus the guide block 210 does not press the stop block 312 in the first direction X.

In S2023, the stop block 312 is pushed by the elastic member 313 to move in the cover opening direction such that the surface of the stop block 312 in the second direction Y abuts against the guide block 210 to prevent the guide block 210 and the top cover 200 from moving in the second direction Y.

After the guide block 210 presses the stop block 312 in the first direction X, the stop protrusion 3121 is pushed to move in the cover opening direction to above the guide block 210 under the action of the elastic member 313 to lock the top cover 200.

The method for using the wireless earphone case is as follows:

Cover opening steps: the flick block 320 is pulled such that the lock assembly 310 is unlocked, then the flick block 320 is pulled upwards and backwards such that the flick block 320 is separated from the drive rod 311, and at the same time, the top cover 200 is driven to move backwards such that the cover is opened.

Cover closing steps: the top cover 200 is pushed to move forwards, and then the top cover 200 is pressed when the top cover 200 contacts the drive rod 311. At this time, the top cover 200 is in the closed position, and the stop block 312 and the stop protrusion 3121 are stuck above the guide block 210 under the action of the elastic member 313 so that the top cover 200 is locked. The elastic member 313 of this embodiment is, for example, a spring. The form of the elastic member 313 is not limited by this embodiment.

When two top covers 200 are provided, one top cover 200 is pulled towards the center of the casing 100 (that is, in the cover opening direction) such that the guide block 210 slides along the first slideway 140. When the guide block 210 is located in the narrow slideway segment 141, the top cover 200 is located above the other top cover 200, and the roller 270 on the bottom surface of the top cover 200 enters the second slideway 260 under the guidance of the guide arc surface 261. In this manner, the one top cover 200 is opened.

It is to be noted that the preceding are only embodiments of the present disclosure and technical principles used therein. It is to be understood by those skilled in the art that the present disclosure is not limited to the embodiments described herein. Those skilled in the art can make various apparent modifications, adaptations and substitutions without departing from the scope of the present disclosure. Therefore, while the present disclosure is described in detail through the preceding embodiments, the present disclosure is not limited to the preceding embodiments and may include more other equivalent embodiments without departing from the concept of the present disclosure. The scope of the present disclosure is determined by the scope of the appended claims.

What is claimed is:

1. A wireless earphone case, having a closed state and an open state and comprising:

a casing, wherein one end of the casing has an opening, and an earphone slot is disposed in the casing;

a top cover slidably mounted on an opening end of the casing, wherein the top cover has a closed position and an open position, wherein the wireless earphone case is in the open state when the top cover is in the open position and the wireless earphone case is in the closed state when the top cover is in the closed position; and a lock mechanism comprising a lock assembly disposed in the casing and a flick block movably disposed on the top cover, wherein the lock assembly comprises two lock groups, each lock group of the two lock groups comprises a stop block and an elastic member, the stop block is slidably disposed on a respective one of two opposite first-side inner walls in a first direction, the elastic member extends in the first direction, two ends of the elastic member are connected to the stop block and a second-side inner wall of the casing in the first direction respectively, the stop block has a stop protrusion on a surface of the stop block facing away from the elastic member, the stop protrusion is configured to abut against the top cover to lock the top cover, and the flick block is configured to move the lock assembly relative to the casing to make the stop block release lock of the top cover.

2. The wireless earphone case of claim 1, wherein the lock assembly further comprises a drive rod connected between the two lock groups, the drive rod is connected to the stop block, and the flick block is configured to move the drive rod in a direction the elastic member is pressable.

3. The wireless earphone case of claim 2, wherein two guide blocks are disposed on a bottom surface of the top cover, wherein the two guide blocks are in one-to-one correspondence with the two lock groups, and for each of the two guide blocks, a guide block is configured to, when the lock groups lock the top cover, abut against a corresponding lock group to prevent the guide block and the top cover from moving in a second direction, wherein the second direction is perpendicular to a first direction.

4. The wireless earphone case of claim 2, wherein two guide blocks are disposed on a bottom surface of the top cover, each of the two opposite first-side inner walls is provided with one first slideway, two first slideways on the two opposite first-side inner walls are in one-to-one correspondence with the two guide blocks, and each of the two guide blocks is slidably disposed in a respective first slideway.

5. The wireless earphone case of claim 4, wherein the first slideway comprises a narrow slideway segment and a wide slideway segment, a width of the wide slideway segment in a second direction is greater than a width of the narrow slideway segment in the second direction, each of the two guide blocks is located in a respective wide slideway segment when the top cover is in the closed position, the narrow slideway segment extends in a first direction, and each of the two guide blocks is slidable in a respective narrow slideway segment.

6. The wireless earphone case of claim 5, wherein a connection between the wide slideway segment and the narrow slideway segment is a tapered structure.

7. The wireless earphone case of claim 1, wherein a mounting slot is disposed on a top surface of the top cover, a through hole is formed on a slot bottom of the mounting slot, the flick block is rotatably disposed in the mounting slot, the flick block has a flick end extending through the through hole, and the flick end is configured to move the lock assembly relative to the casing.

8. The wireless earphone case of claim 7, wherein the flick block has a first circular arc surface, the top cover has a second circular arc surface, and the flick block has an initial state and a flicked state, wherein when the flick block is in the initial state, a top surface of the flick block is coplanar with the top surface of the top cover, and the first circular arc surface and the second circular arc surface form a grip slot, and when the flick block is in the flicked state, the flick end abuts against the lock assembly.

9. The wireless earphone case of claim 1, wherein two guide blocks are disposed on a bottom surface of the top cover, wherein the two guide blocks are in one-to-one correspondence with the two lock groups, and for each of the two guide blocks, a guide block is configured to, when the lock groups lock the top cover, abut against a corresponding lock group to prevent the guide block and the top cover from moving in a second direction, wherein the second direction is perpendicular to a first direction.

10. The wireless earphone case of claim 1, wherein two guide blocks are disposed on a bottom surface of the top cover, each of the two opposite first-side inner walls is provided with one first slideway, two first slideways on the two opposite first-side inner walls are in one-to-one correspondence with the two guide blocks, and each of the two guide blocks is slidably disposed in a respective first slideway.

11. The wireless earphone case of claim 10, wherein the first slideway comprises a narrow slideway segment and a wide slideway segment, a width of the wide slideway segment in a second direction is greater than a width of the narrow slideway segment in the second direction, each of the two guide blocks is located in a respective wide slideway segment when the top cover is in the closed position, the narrow slideway segment extends in a first direction, and each of the two guide blocks is slidable in a respective narrow slideway segment.

12. The wireless earphone case of claim 11, wherein a connection between the wide slideway segment and the narrow slideway segment is a tapered structure.

13. A wireless earphone case, having a closed state and an open state and comprising:

a casing, wherein one end of the casing has an opening, and an earphone slot is disposed in the casing;

a top cover slidably mounted on an opening end of the casing, wherein the top cover has a closed position and an open position, wherein the wireless earphone case is in the open state when the top cover is in the open position and the wireless earphone case is in the closed state when the top cover is in the closed position, a guide block is disposed on a bottom surface of the top cover, a first-side inner wall of the casing is provided with a first slideway, the guide block is slidably disposed in the first slideway corresponding to the guide block, the first slideway comprises a narrow slideway segment and a wide slideway segment, a width of the wide slideway segment in a second direction is greater than a width of the narrow slideway segment in the second direction, the guide block is located in a respective wide slideway segment when the top cover is in the closed position, the narrow slideway segment extends in a first direction, the guide block is slidable in a respective narrow slideway segment, and the second direction is perpendicular to the first direction;

a lock mechanism comprising a lock assembly disposed in the casing and a flick block movably disposed on the top cover, wherein the flick block is configured to move the lock assembly relative to the casing to make the lock assembly release lock of the top cover.

14. The wireless earphone case of claim 13, wherein two guide blocks are disposed on a bottom surface of the top cover, each of the two opposite first-side inner walls is provided with one first slideway, two first slideways on the two opposite first-side inner walls are in one-to-one correspondence with the two guide blocks, and each of the two guide blocks is slidably disposed in a respective first slideway.

15. The wireless earphone case of claim 13, wherein a connection between the wide slideway segment and the narrow slideway segment is a tapered structure.

16. The wireless earphone case of claim 14, wherein a connection between the wide slideway segment and the narrow slideway segment is a tapered structure.

17. A wireless earphone case, having a closed state and an open state and comprising:

a casing, wherein one end of the casing has an opening, and an earphone slot is disposed in the casing;

a top cover slidably mounted on an opening end of the casing, wherein the top cover has a closed position and an open position, wherein the wireless earphone case is in the open state when the top cover is in the open position and the wireless earphone case is in the closed state when the top cover is in the closed position;

a lock mechanism comprising a lock assembly disposed in the casing and a flick block movably disposed on the top cover, wherein a mounting slot is disposed on a top surface of the top cover, a through hole is formed on a slot bottom of the mounting slot, the flick block is rotatably disposed in the mounting slot, the flick block has a flick end extending through the through hole, and the flick end is configured to move the lock assembly relative to the casing to make the lock assembly release lock of the top cover.

18. The wireless earphone case of claim 17, wherein the flick block has a first circular arc surface, the top cover has a second circular arc surface, and the flick block has an initial state and a flicked state, wherein when the flick block is in the initial state, a top surface of the flick block is coplanar with the top surface of the top cover, and the first circular arc surface and the second circular arc surface form a grip slot, and when the flick block is in the flicked state, the flick end abuts against the lock assembly.

* * * * *